US009042744B2

(12) United States Patent
Adachi et al.

(10) Patent No.: US 9,042,744 B2
(45) Date of Patent: May 26, 2015

(54) IMAGE FORMING APPARATUS

(71) Applicant: CANON KABUSHIKI KAISHA, Tokyo (JP)

(72) Inventors: Motoki Adachi, Ashigarakami-gun (JP); Hideaki Hasegawa, Suntou-gun (JP); Takayoshi Kihara, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 47 days.

(21) Appl. No.: 13/895,417

(22) Filed: May 16, 2013

(65) Prior Publication Data

US 2013/0308964 A1 Nov. 21, 2013

(30) Foreign Application Priority Data

May 17, 2012 (JP) ..... 2012-113520

(51) Int. Cl.
*G03G 15/00* (2006.01)

(52) U.S. Cl.
CPC ..... *G03G 15/553* (2013.01); *G03G 15/5037* (2013.01); *G03G 15/5079* (2013.01); *G03G 15/55* (2013.01)

(58) Field of Classification Search
CPC ..... G03G 15/55; G03G 15/751
See application file for complete search history.

(56) References Cited

U.S. PATENT DOCUMENTS

| | | | | |
|---|---|---|---|---|
| 6,546,212 | B1 * | 4/2003 | Ogata et al. | 399/24 |
| 8,391,749 | B2 | 3/2013 | Inoue | |
| 2007/0127935 | A1 * | 6/2007 | Inami et al. | 399/12 |
| 2010/0239280 | A1 | 9/2010 | Inoue | |
| 2012/0213538 | A1 * | 8/2012 | Tomaru | 399/66 |

FOREIGN PATENT DOCUMENTS

| | | | |
|---|---|---|---|
| JP | 4-16865 | A | 1/1992 |
| JP | 2007-52126 | A | 3/2007 |
| JP | 2009-237291 | A | 10/2009 |
| JP | 2010-217627 | A | 9/2010 |

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes a rotatable photosensitive member, an exposure unit for exposing a surface of the photosensitive member to light, and a detecting portion for detecting a lifetime of the photosensitive member on the basis of a thickness of a charge transporting layer of the photosensitive member and an amount of the light received by the charge transporting layer of the photosensitive member.

9 Claims, 7 Drawing Sheets

| THICKNESS T(μm) | FATIQUE COEFFICIENT | |
|---|---|---|
| | EMB.1 | EMB.4 |
| 15≥T>14 | 1.0 | 0.80 |
| 14≥T>13 | 1.0 | 0.80 |
| 13≥T>12 | 1.0 | 0.85 |
| 12≥T>11 | 1.0 | 0.90 |
| 11≥T>10 | 1.0 | 0.95 |
| 10≥T>9 | 1.0 | 1.00 |
| 9≥T>8 | 1.0 | 1.05 |
| 8≥T>7 | 1.0 | 1.15 |
| 7≥T>6 | 1.0 | 1.20 |

IMAGE FORMING APPARATUS

FIELD OF THE INVENTION AND RELATED ART

The present invention relates to an image forming apparatus. Specifically, the present invention relates to the image forming apparatus in which image formation is executed by applying an electrophotographic image forming process to a surface of a rotatable photosensitive member and then the photosensitive member is repetitively subjected to the image formation.

In the present invention, the image forming apparatus may include image forming apparatuses such as a copying machine, a printer, a facsimile machine, a multi-function machine of these machines, and the like, in which a toner image formed on the surface of the photosensitive member by the electrophotographic image forming process is transferred onto a recording material directly or via an intermediary transfer member and then is fixed as a fixed image, and thereafter the recording material is outputted as an image-formed product. The photosensitive member after the toner image is transferred onto the recording material or the intermediary transfer member is cleaned by a cleaning means and then is repetitively subjected to image formation.

The image forming apparatus of the present invention also includes an image forming apparatus (display apparatus, electronic blackboard, electronic white board, or the like). In the image forming apparatus, the toner image after being formed on the photosensitive member or the intermediary transfer member and then being displayed at a display portion is removed from the photosensitive member or the intermediary transfer member by the cleaning means and then the photosensitive member and the intermediary transfer member are repetitively subjected to the image formation. Further, as desired, the toner image after being formed on the photosensitive member or the intermediary transfer member and then being displayed at the display portion is transferred onto the recording material. Then, the recording material on which the toner image is fixed as the fixed image is outputted as the image-formed product.

It has been conventionally known that a drum type photosensitive member (hereinafter referred to as a photosensitive drum) as a rotatable image bearing member incorporated into an ordinary electrophotographic image forming apparatus is deteriorated correspondingly to an operation time due to repetition of an electrophotographic image forming process including charging, exposure and the like. As the photosensitive member which is the rotatable image bearing member, there is also a photosensitive member of an endless belt type.

Further, the photosensitive drum having reached an end of its lifetime is constituted to be exchanged (replaced) quickly. As a means for detecting the lifetime of the photosensitive drum, a method of discriminating a degree of the deterioration of the develop, i.e., whether or not the photosensitive drum reaches the end of its lifetime by measuring a surface potential of the photosensitive drum has been known.

However, in the above method, there is a need to provide a measuring means for measuring the surface potential of the photosensitive drum, thus adversely affecting increases in size and cost of the apparatus because of ensuring of a space where the measuring means is to be placed. For that reason, as disclosed in Japanese Laid-Open Patent Application (JP-A) Hei 4-16865, a method of discriminating the end of the lifetime of the photosensitive drum on the basis of the number of rotations (rotation number) has been known.

However, a degree of a change in sensitivity of the photosensitive drum varies depending on a use status of a user. Particularly, the degree of the sensitivity change is changed depending on a received light quantity of the photosensitive drum. In the conventional lifetime (end) discriminating method based on only the rotation number of the photosensitive drum, the received light quantity of the photosensitive drum is not taken into consideration, and therefore particularly when lifetime extension is intended to be achieved, a deviation between a result of the lifetime discrimination and an original lifetime of the photosensitive drum was somewhat generated. For that reason, in consideration of this deviation, notification that the photosensitive drum reaches the end of its lifetime was made on the basis of the rotation number of the photosensitive drum so as to maintain an image quality even in various use statuses.

It is desired that also the photosensitive drum compatibly realizes image quality and lifetime extension so as to meet recent demands for lifetime extension and image quality improvement of a product. For that reason, it is important that the end of the lifetime of the photosensitive drum is accurately discriminated and that the photosensitive drum is used to the possible extent.

SUMMARY OF THE INVENTION

A principal object of the present invention is to provide an image forming apparatus capable of discriminating an end of a lifetime of a photosensitive member in order to solve the above-described problem.

According to an aspect of the present invention, there is provided an image forming apparatus comprising: a rotatable photosensitive member; an exposure unit for exposing a surface of the photosensitive member to light; and a detecting portion for detecting a lifetime of the photosensitive member on the basis of first information on a thickness of a charge transporting layer of the photosensitive member and second information on an amount of the light received by the charge transporting layer of the photosensitive member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

[Embodiment 1]

An image forming apparatus 1 in this embodiment will be described specifically with reference to the drawings.

<General Structure of Image Forming Apparatus>

Figure 2:
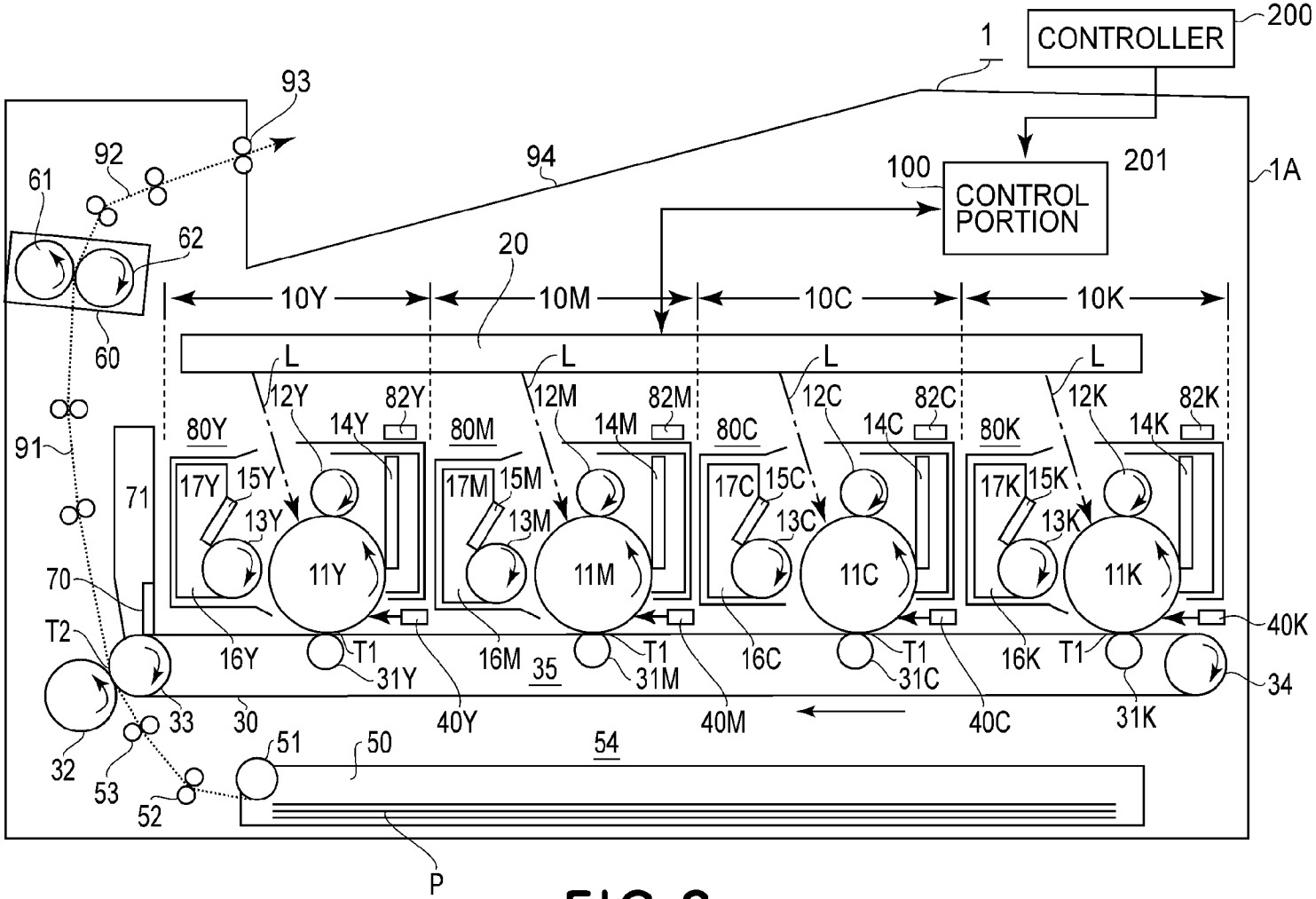
FIG. 2 is a schematic illustration of the image forming apparatus in Embodiment 1.

FIG. 2 is a schematic illustration showing a general structure of the image forming apparatus 1 in this embodiment, and is a four color-based full-color laser beam printer (electrophotographic image forming apparatus) using an electrophotographic image forming process of an intermediary transfer type. The image forming apparatus 1 is capable of outputting an image-formed product by forming an image, on a recording material P as a recording medium, corresponding to image data (electrical image information) inputted from a printer controller (external host device) 200 connected to a printer control portion 100 via an interface 201.

The control portion 100 is a means for controlling an operation of the image forming apparatus 1, and transfers various electrical information signals with the printer controller 200. Further, the control portion 100 effects processing of the electrical information signals inputted from various process devices and sensors, processing of command signals to the various process devices, predetermined initial sequence control and predetermined image forming sequence control. The printer controller 200 is a host computer, a network, an image reader, a facsimile machine, or the like.

Inside an apparatus main assembly 1A of the image forming apparatus 1, from a left side to a right side in FIG. 2, four (first to fourth) image forming stations (image forming units) 10 (10Y, 10M, 10C and 10K) are juxtaposed at regular intervals in a substantially horizontal direction (so-called tandem type).

The image forming stations 10 are electrophotographic image forming mechanisms having the same mechanism constitution except that colors of yellow (Y), magenta (M), cyan (C) and black (K) of developers (toners) accommodated in developing means are different from each other. In many cases, common constitution and operation and employed in the respective image forming station 10. Therefore, in the following, in the case where particular distinction is not needed, suffixes Y (yellow), M (magenta), C (cyan) and K (black) for representing devices or elements provided for associated colors are omitted and will be collectively described.

Figure 3:
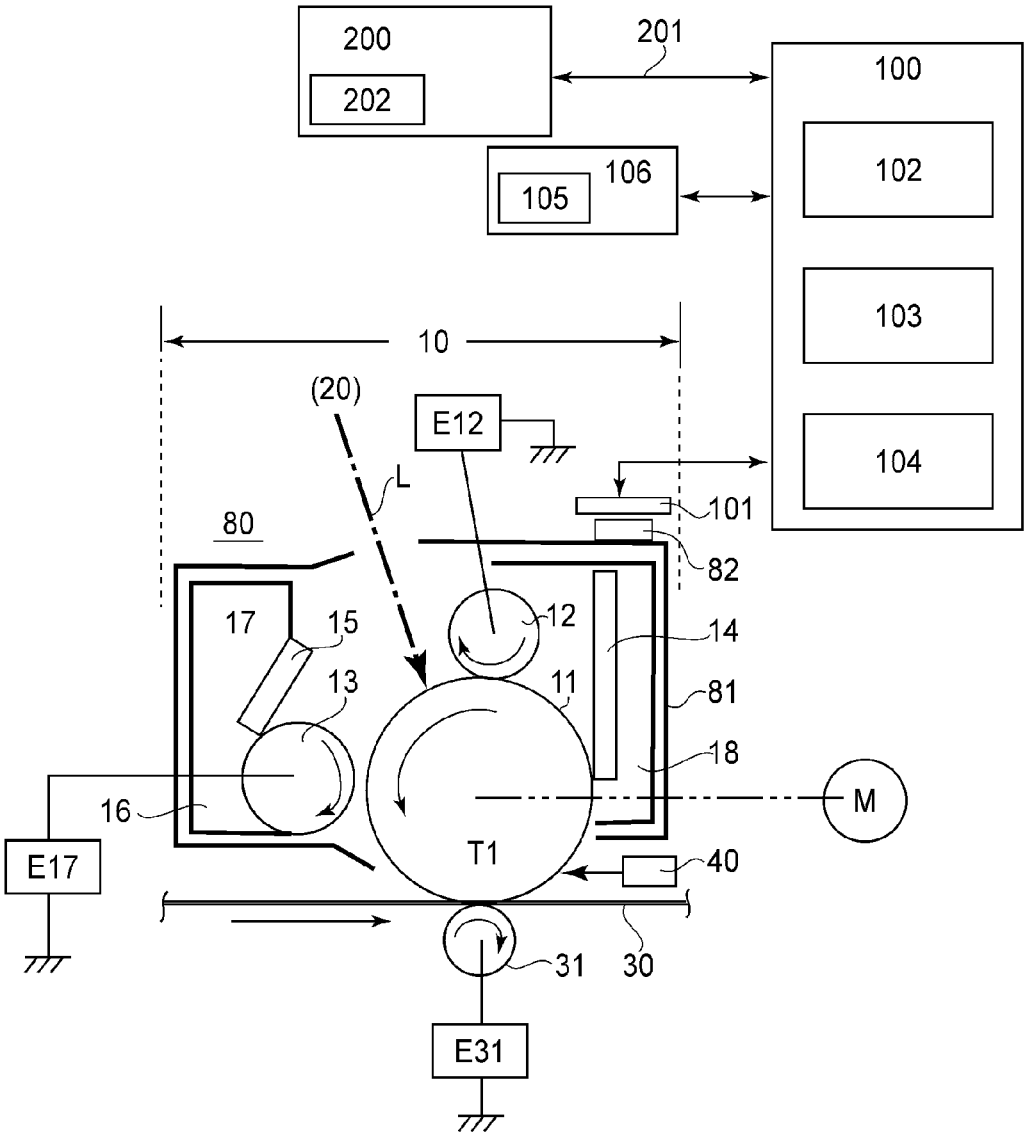
FIG. 3 is a partial enlarged view of FIG. 1.

FIG. 3 is an enlarged view of one of the four image forming stations 10 described above. Each image forming station 10 includes a rotation drum type electrophotographic photosensitive member (photosensitive drum) 11 as a rotatable image bearing member (first image bearing member). Each photosensitive drum 11 is rotationally driven by a driving means M in the counterclockwise direction (arrow direction) at a surface movement speed of 120 mm/sec in this embodiment and at predetermined control timing on the basis of input of a print signal from the printer controller 200 into the control portion 100.

At a periphery of the photosensitive drum 11, along a rotation direction of the photosensitive drum 11, the following process means as electrophotographic image forming process means acting on the photosensitive drum 11 are provided. That is, a charging means 12, an image exposure means 20, a developing means 17, a transfer means 31, a discharging means 40, a toner removing means 14, and the like are provided in this order.

In the image forming apparatus 1 in this embodiment, at each image forming station 10, four devices consisting of the photosensitive drum 11, the charging means 12, the developing means 17 and the toner removing means 14 are assembled into a cartridge casing 81 at predetermined positions to prepare a process cartridge 80.

Each cartridge 80 is provided in predetermined procedure and manner so as to be detachably mountable to a predetermined mounting portion in the apparatus main assembly 1A. In a state in which the cartridge 80 is mounted in the predetermined manner at the predetermined mounting portion in the apparatus main assembly 1A, a drive input portion (not shown) of the cartridge 80 and a drive output portion (not shown) of the apparatus main assembly 1A are connected with each other. As a result, the photosensitive drum 11 and the developing means 17 of the cartridge 80 can be driven by the driving means M in the apparatus main assembly 1A. The driving means M is controlled by the control portion 100.

Further, in the state in which the cartridge 80 is mounted in the predetermined manner at the predetermined mounting portion in the apparatus main assembly 1A, an input electric portion (not shown) of the cartridge 80 and an output electric portion (not shown) of the apparatus main assembly 1A are connected with each other. As a result, predetermined charging bias and developing bias are applicable at predetermined control timing from power source portions E12 and E17 to the charging means 12 and the developing means 17, respectively, of the cartridge 80. The power source portions E12 and E17 are controlled by the controller 100.

Further, the cartridge 80 is provided with a memory (storing) medium (non-volatile memory) 82. In the state in which the cartridge 80 is mounted in the predetermined manner at the predetermined mounting portion in the apparatus main assembly 1A, the memory medium 82 of the cartridge 80 and information transmitting means 101 of the apparatus main assembly 1A are electrically connected with each other. The control portion 100 can read out the information stored in the memory medium 82 of the cartridge 80. Further, the control portion 100 can write necessary information in the memory medium 82.

In this embodiment, the photosensitive drum 11 is prepared by coating at least a charge generating layer and a charge transporting layer in thin films on an aluminum cylinder, of 30 mm in outer diameter, as an electroconductive base material.

In the charge generating layer, a phthalocyanine compound having good sensitivity is used. As the phthalocyanine compound, it is possible to use those represented by, e.g., copper phthalocyanine, oxytitanium phthalocyanine, silicon phthalocyanine, and gallium phthalocyanine. In this embodiment, gallium phthalocyanine was used.

The charge transporting layer is coated on the charge generating layer in a thickness of 15 μm. As a material for the charge transporting layer, it is possible to use polymethyl methacrylate, polystyrene, styrene-acrylonitrile copolymer, polycarbonate resin, diallyl phthalate resin, and polyallylate resin. In this embodiment, a polycarbonate compound was used.

The charging means 12 is a means for electrically charging the surface of the photosensitive drum 11 uniformly to a predetermined potential and a predetermined polarity. In this embodiment, as the charging means, a charging roller which is a contact charging member is used. The charging roller 12 includes a core metal and an electroconductive elastic layer formed coaxially with the core metal and is provided in substantially parallel with the photosensitive drum 11. The charging roller 12 is press-contacted to the photosensitive drum 11 at a predetermined urging force against elasticity of the electroconductive elastic layer. The core metal is rotatably shaft-supported at its end portions, so that the charging roller 12 is rotated by rotation of the photosensitive drum 11.

In this embodiment, at predetermined control timing after the photosensitive drum 11 is rotationally driven, to the core metal of the charging roller 12, a DC voltage of about −1000 V is applied as a charging bias from the power source portion E12. As a result, the surface of the photosensitive drum 11 is contact-charged uniformly to a surface potential (dark portion potential VD) of about −450 V.

The image exposure means 20 is a laser exposure unit in this embodiment. The laser exposure unit 20 includes a laser output portion for outputting laser light correspondingly to a digital pixel signal inputted from the control portion 100, and includes a rotatably polygonal mirror, fθ lens, a reflection mirror, and the like, although these members are omitted from illustration.

The laser exposure unit 20 subjects the surface of the photosensitive drum 11 uniformly charged by the charging roller 12 to main-scanning exposure to laser light L modulated correspondingly to the digital pixel signal. As a result, a potential of an exposed portion on the surface of the photosensitive drum 11 is attenuated from the dark portion potential VD to an exposed portion potential VL (about −100 V). For that reason, an electrostatic latent image corresponding to a scanning exposure pattern is formed on the photosensitive drum 11 on the basis of a potential contrast (latent image contrast) between the dark portion potential VD and the exposed portion potential VL.

The developing means 17 is a means for forming a toner image by supplying a toner as a developer to the electrostatic latent image formed on the surface of the photosensitive drum 11. In this embodiment, the developing means 17 is a jumping positioning device (non-magnetic one-component non-contact developing device) using a non-magnetic one-component toner (having negatively chargeable characteristic) as the developer.

The developing device 17 includes a rotatable developing sleeve 13 for carrying the toner accommodated in a developer container 16 and for conveying the toner to an opposing portion where the developing sleeve 13 opposes the photosensitive drum 11. Further, the developing device 17 includes a developing blade 15 for uniformizing a toner layer (thickness) on the developing sleeve 13.

Here, in a developer container 16Y of the cartridge 80Y at the first image forming station 10Y, the toner of yellow (Y) is accommodated. Accordingly, the toner image of Y is formed on the photosensitive drum 11Y. In a developer container 16M of the cartridge 80M at the second image forming station 10M, the toner of magenta (M) is accommodated. Accordingly, the toner image of M is formed on the photosensitive drum 11M.

Further, in a developer container 16C of the cartridge 80C at the third image forming station 10C, the toner of cyan (C) is accommodated. Accordingly, the toner image of C is formed on the photosensitive drum 11C. In a developer container 16K of the cartridge 80K at the fourth image forming station 10K, the toner of black (K) is accommodated. Accordingly, the toner image of K is formed on the photosensitive drum 11K.

The developing sleeve 13 is constituted by an aluminum sleeve of 16 mm in diameter as a base material and a coating layer of a binder resin. In the coating layer, particles are added, so that the developing sleeve 13 has a proper surface roughness by the particles. The developing sleeve 13 is disposed in parallel to the photosensitive drum 11, so that a gap of about 250 μm is provided between the photosensitive drum 11 and the developing sleeve 13.

The developing blade 15 includes an elastic material blade for regulating a layer thickness of the non-magnetic toner carried on the developing sleeve 13. The developing blade 15 is formed with a rubber member such as silicone rubber or urethane rubber, and is contacted to the developing sleeve 13 at its free end and at a predetermined urging force.

At predetermined control timing after the photosensitive drum 11 is rotationally driven, the developing sleeve 13 is rotationally driven in the clockwise direction (arrow direction) at a predetermined peripheral speed, so that the toner charged to the negative polarity by friction is carried and conveyed to a developing position where the developing sleeve 13 opposes the photosensitive drum 11. During an image forming step, to the developing sleeve 13, a developing bias in the form of an AC voltage of 1200 Vpp (peak-to-peak voltage) and 1800 Hz in frequency biased with a DC voltage of −350 V is applied.

As a result, at the developing position, the toner jumps in a vibratory manner at a gap portion between the developing sleeve 13 and the photosensitive drum 11 to be selectively deposited on the surface of the photosensitive drum 11 at a portion having the exposed portion potential VL, so that the electrostatic latent image on the photosensitive drum S is reversely developed with the negatively charged toner. That is, the electrostatic latent image formed on the surface of the photosensitive drum 11 is developed and visualized with the toner on the developing sleeve 13 by a potential difference (developing contrast) between the DC voltage applied to the developing sleeve 13 and the exposed portion potential VL.

The transfer means 31 is a means for primary-transferring the toner image from the photosensitive drum 11 onto an intermediary transfer belt 30, described later, as an intermediary transfer member (second image bearing member). In this embodiment, as the transfer means 31, a primary transfer roller is used. The transfer roller 31 is constituted in a roller shape such that an electroconductive elastic layer is provided on a shaft, and is disposed substantially parallel to the photosensitive drum 11 so as to be contacted to the intermediary transfer belt 30 toward the photosensitive drum 11 at a predetermined urging force. A control portion between the intermediary transfer belt 30 and the photosensitive drum 11 is a primary transfer position T1.

To the shaft of the primary transfer roller 31, at predetermined control timing, a DC voltage of the positive polarity (opposite to the toner charge polarity) is applied from a power source portion E31, so that a transfer electric field is formed.

The (electrically) discharging means 40 is a means for electrically discharging the surface potential of the photosensitive drum 11, after the primary transfer of the toner image onto the intermediary transfer belt 30, to substantially uniformize the surface potential. In this embodiment, the discharging means 40 is an exposure discharging means, and a discharging LED unit is used.

The discharging LED unit 40 is constituted by a lamp array (eraser lamps) in which a plurality of small LED lamps arranged in line at predetermined intervals in a direction of generatrix of the photosensitive drum 11 and electric contacts for supplying a voltage to the LED, and is turned on and off depending on a control signal from the control portion 100. The discharging LED unit 40 is disposed, inside the apparatus main assembly 1A so as to oppose the photosensitive drum 11 with a predetermined distance, between the primary transfer position T1 and a drum cleaner 14 as the toner removing means.

By turning on all the LED lamps of the discharging LED unit, the surface of the rotating photosensitive drum 11 is exposed to light (whole surface exposure) at substantially uniform luminance with respect to the photosensitive drum generatrix direction at a position between the primary transfer position T1 and the drum cleaner 14. As a result, a residual potential on the photosensitive drum surface is attenuated, so that the photosensitive drum surface is discharged substantially uniformly. That is, the discharging LED unit 40 is a discharging means for removing the surface potential, of the photosensitive drum 11 after the transfer, by irradiating the photosensitive drum surface with light.

Incidentally, the discharging means 40 can also be disposed at a position between the charging roller 12 and the drum cleaner 14 described below as the toner removing means.

The drum cleaner 14 as the toner removing means is a means for cleaning the photosensitive drum surface by removing a transfer residual toner from the surface of the photosensitive drum 11 after the primary transfer of the toner image onto the intermediary transfer belt 30. In this embodiment, the drum cleaner 14 is disposed, in contact with the photosensitive drum 11, between the discharging LED unit 40 and the charging roller 12. The drum cleaner 14 is prepared by providing a plate-like elastic member on a metal plate, and is contacted, at an end of the elastic member, to the photosensitive drum surface in a so-called counter direction to the develop surface at a predetermined urging force. As a material for the elastic member, polyurethane is employed from viewpoints of anti-wearing property, plastic deformation property, and the like.

The transfer residual toner on the photosensitive drum surface is scraped off and removed from the photosensitive drum surface by the drum cleaner 14. The scraped toner is accommodated in a cleaner container 18. The photosensitive drum 11 of which surface is cleaned is repetitively subjected to image formation.

At a lower portion of the first to fourth image forming stations 10, an intermediary transfer belt unit 35 is provided. The intermediary transfer belt unit 35 includes a secondary transfer opposite roller 33 and a driving roller 34 which are provided in parallel to each other in the first image forming station 10Y side and the fourth image forming station 10K side, respectively, and includes the flexible intermediary transfer belt 30 which is stretched between these two rollers 33 and 34. The first to fourth image forming stations 10 are disposed along an upper side of an upper belt portion between the rollers 33 and 34.

Each primary transfer roller 30 is disposed inside the intermediary transfer belt 30 substantially parallel to the axis (shaft) of the associated photosensitive drum 11, and is contacted to a lower surface of the upper belt portion of the intermediary transfer belt 30 toward the photosensitive drum 11. Further, the secondary transfer roller 32 is disposed opposed to the secondary transfer opposite roller 33 via the intermediary transfer belt 30, and is contacted to the intermediary transfer belt 30 toward the secondary transfer opposite roller 33 in a state in which proper pressure is applied thereto. A contact portion between the secondary transfer roller 32 and the intermediary transfer belt 30 is the secondary transfer position T2.

In this embodiment, the intermediary transfer belt 30 is prepared by forming a resin film, of about $10^{11}$-$10^{16}$ Ω·cm in electric resistance (volume resistivity) and 100-200 μm in thickness, in an endless belt shape. The resin film is a film of PVdf (polyvinylidene fluoride), nylon, PET (polyethylene terephthalate), PC (polycarbonate), or the like.

The driving roller 34 is rotationally driven in the clockwise direction (arrow direction) at a predetermined peripheral speed by the driving means M at predetermined control timing on the basis of input f a print signal into the control portion 100. As a result, the intermediary transfer belt 30 is driven and circulated in the clockwise direction (arrow direction), which is the same direction as the rotational direction of the photosensitive drums 11 of the image forming stations 10, at a speed (predetermined process speed) corresponding to the rotational speed of the photosensitive drums 11. The secondary transfer opposite roller 33, the respective primary transfer rollers 31, and the secondary transfer roller 32 are rotated by movement of the intermediary transfer belt 30.

At a portion where the intermediary transfer belt 30 is wound along the secondary transfer opposite roller 33, a belt cleaner 70 is provided in contact with the surface of the intermediary transfer belt 30 in a downstream side of the secondary transfer position T2 with respect to a belt movement direction.

The belt cleaner 70 is a toner removing means for removing a secondary transfer residual toner remaining on the intermediary transfer belt surface after the secondary transfer of the toner image from the surface of the intermediary transfer belt 30 onto the recording material P at the secondary transfer position T2. The secondary transfer residual toner on the surface of the intermediary transfer belt 30 is scraped off from the belt surface by the belt cleaner 70. The scraped toner is accommodated in a cleaner container 71. The intermediary transfer belt 31 of which surface is cleaned is repetitively subjected to the image formation.

Below the intermediary transfer belt unit 35, a sheet-feeding unit 54 is provided. The sheet-feeding unit 54 is constituted by a cassette 50 for accommodating sheets of the recording material (transfer material) P, a pick-up roller 51 for feeding the sheets of the recording material one by one from the cassette 50, sheet-feeding roller pairs 52 and 53 for feeding (conveying) the recording material P fed from the pick-up roller 51, and the like.

The sheet of the recording material P separated and fed from the cassette 50 is introduced into the secondary transfer position T2 at predetermined control timing, and then is subjected to the secondary transfer of the toner image from the intermediary transfer belt 30. The secondary transfer roller 32 is an electroconductive roller similarly as the primary-transfer roller 31, and is constituted so that a transfer electric field is formed by applying, to its shaft, a DC voltage of the positive polarity (opposite to the toner charge polarity) from a power source portion (not shown) of the apparatus main assembly 1A at predetermined control timing.

The recording material P passed through the second transfer position T2 is separated from the intermediary transfer belt 30 and then is sent upward by a conveying path 91, thus being introduced into a fixing unit 60. The fixing unit 60 is constituted by a fixing roller 62 to be temperature-controlled to a predetermined temperature by being heated by a fixing heater (not shown), and a pressing roller 61 pressed against the fixing roller 62 at predetermined pressure. The recording material P is nipped and conveyed at a nip between the fixing roller 62 and the pressing roller 61, so that the toner image is fixed on the recording material P. That is, the toner image is fixed as a fixed image on the recording material P under application of heat and pressure.

The recording material P passed through the fixing unit 60 passes through a conveying path 92, and then is discharged as an image-formed product from a discharging opening 93 onto a discharge tray 94 provided at an upper surface of the image forming apparatus 1.

In the case of a full-color image forming mode (hereinafter referred to as a color mode), the first to fourth (four) image forming stations 10 perform the image forming operation in parallel.

That is, by the above-described electrophotographic image forming process, the Y toner image corresponding to a Y component of the full-color image is formed on the photosensitive drum 11Y of the first image forming station 10Y. The toner image is primary-transferred onto the intermediary transfer belt 30 at the primary transfer position T1.

The M toner image corresponding to an M component of the full-color image is formed on the photosensitive drum 11M of the first image forming station 10M. The toner image is primary-transferred superposedly onto the Y toner image which has already been transferred on the intermediary transfer belt 30 at the primary transfer position T1.

The C toner image corresponding to a C component of the full-color image is formed on the photosensitive drum 11C of the first image forming station 10C. The toner image is primary-transferred superposedly onto the Y and M toner images which have already been transferred on the intermediary transfer belt 30 at the primary transfer position T1.

The K toner image corresponding to a K component of the full-color image is formed on the photosensitive drum 11K of the first image forming station 10K. The toner image is primary-transferred superposedly onto the Y, M and C toner images which have already been transferred on the intermediary transfer belt 30 at the primary transfer position T1.

Thus, an unfixed full-color toner image based on the toner images of Y, M, C and K is synthetically formed on the intermediary transfer belt 30. Then, the toner images are conveyed to the secondary transfer portion by further movement of the intermediary transfer belt 30, thus being collectively secondary-transferred onto the recording material P. The recording material P is introduced into the fixing unit 60 and then is subjected to fixing (melting and mixing of the four color toner images), so that the recording material P is discharged as a full-color image-formed product onto the discharge tray 94.

Further, the image forming apparatus 1 in this embodiment is operable, in addition to the above-described color mode, in a monochromatic image forming mode in which the image formation of a single color is effected (hereinafter referred to as a monochromatic mode). Switching between the color mode and the monochromatic mode is controlled by a signal sent from the controller 200 to the control portion 100.

The image forming operation in the monochromatic mode is, in this embodiment, performed only by the four image forming station 10K which is the image forming station for K. For that reason, there is no need to perform the image forming operation by the first to third image forming stations 10Y, 10M and 10C which are the image forming stations for Y, M and C, respectively.

Therefore, during the operation in the monochromatic mode, the developing sleeves 13 of the first to third image forming stations 10Y, 10M and 10C are put on stand-by in a state in which no rotational force is transmitted. That is, the developing sleeves 13 are in a rest state. Further, the photosensitive drums 11 of the first to third image forming stations 10Y, 10M and 10C are rotationally driven together with the photosensitive drum 11 of the fourth image forming station 10K so as not to generate a memory due to friction by the contact with the intermediary transfer belt 30. At this time, no voltage is applied to the charging rollers 12 of the first to third image forming stations 10Y, 10M and 10C, and the LED lamps of the discharging LED units 40 are not turned on.

<Sequence During Printing Operation>

Figure 4:
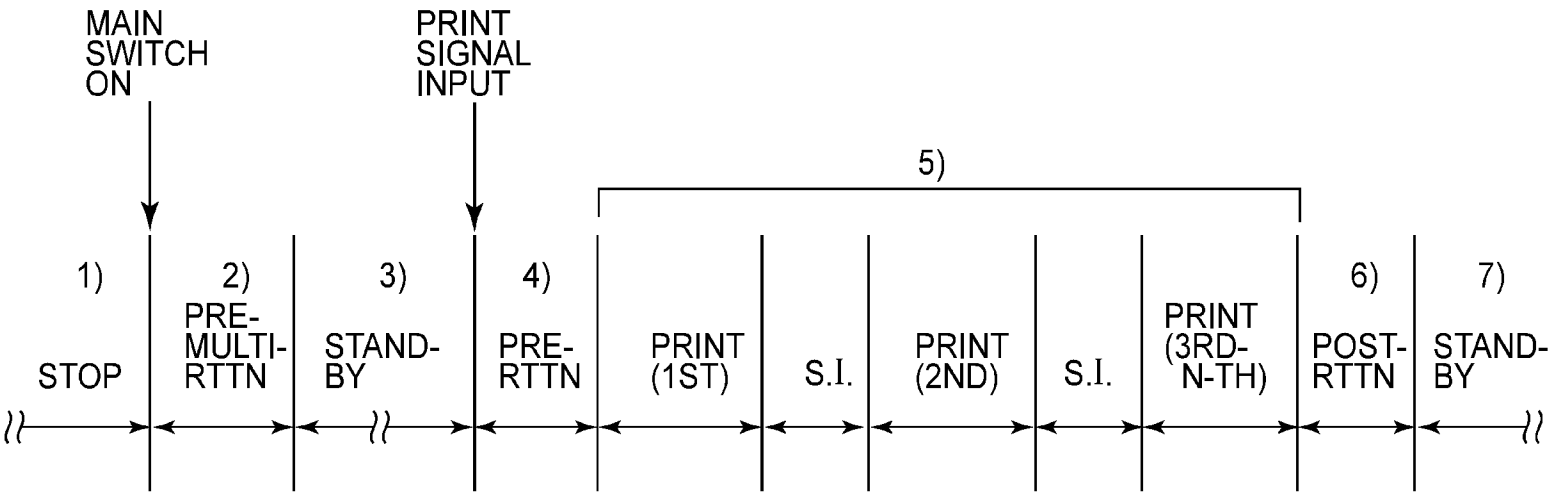
FIG. 4 is a sequence diagram of an image forming operation of the image forming apparatus in Embodiment 1.

FIG. 4 is a sequence diagram during the image forming operation of the image forming apparatus 1 .

1) Stop State

In this state, a main power switch (not shown) of the image forming apparatus 1 is turned off. Therefore, the operation of the image forming apparatus 1 is stopped.

2) Pre-multi-rotation Step

This step is executed in an initializing operation period (warming period) of the image forming apparatus 1 when the main power switch is turned on. The driving means (main motor) M is actuated, so that the photosensitive drum 1 of each image forming station 10, the intermediary transfer belt 30 and the like are rotationally driven. Further, predetermined preparatory operations of other process devices are executed. Also the fixing unit 60 is driven, so that the fixing roller 61 is heated up to a predetermined temperature.

3) Stand-by State

In this state, after the predetermined pre-multi-rotation step is ended, the drive of the driving means M is stopped, and is put on stand-by for input of a print signal (image formation start command or print job start command) from the controller 200 into the control portion 100.

4) Pre-rotation Step

In a pre-image forming operation period, on the basis of the input of the print signal, the driving means M is actuated again to rotationally drive the photosensitive drum(s) 11, the intermediary transfer belt 30 and the like, and at the same time, necessary print preparatory operations of other necessary process devices are executed.

Specifically, a: receiving of the print signal from the controller 200 by the control portion 100, b: development of image information by a formatter (although a development time varies depending on an image information data amount and a processing speed of the formatter), and c: start of the pre-rotation step are performed in this order.

Incidentally, in the case where the print signal is inputted during the pre-multi-rotation step (step 2), the sequence goes, after the step 2, to the pre-rotation step (step 4) with no stand-by state ("3) stand-by state").

5) Print Step (Image Forming Step)

In this step, printing of a predetermined one sheet (monochromatic print) or a plurality of consecutive sheets (multi-print) on the basis of the inputted print signal is executed. That is, when the pre-rotation step (step 4) is ended, the print step is subsequently performed, so that the recording material (recording paper) P on which the image has already been formed is outputted.

In the case of the multi-print, the print step is repeated, so that a predetermined number of sheets of the image-formed recording material P are successively outputted. In the multi-print, an interval step between a trailing end of a certain recording material P and a leading end of a subsequent recording material P is a sheet interval step ("S.I."). In the sheet interval step before the printing operation of a subsequent recording material, predetermined processing is effected and thereafter the sequence goes to the print steps of a second sheet and later.

6) Post-rotation Step

In a post-image forming operation period, after the predetermined print step is ended, predetermined print ending operations of the necessary process devices are executed. That is, the driving means M is continuously driven for a predetermined time even after the output of one sheet of the image-formed recording material P in the case of the monochromatic print and even after the output of the final sheet, of the image-formed recording material P, of the plurality of consecutive sheets. In these periods, predetermined post-image forming operations of the necessary process devices are executed.

7) Stand-by State

After the predetermined post-rotation step is ended, the drive of the driving means M is stopped, and the image forming apparatus 1 is returned to the state in which it is put on stand-by for the input of the print signal from the controller 200 into the control portion 100.

<Factor of Photosensitive Drum Lifetime>

Figure 5:
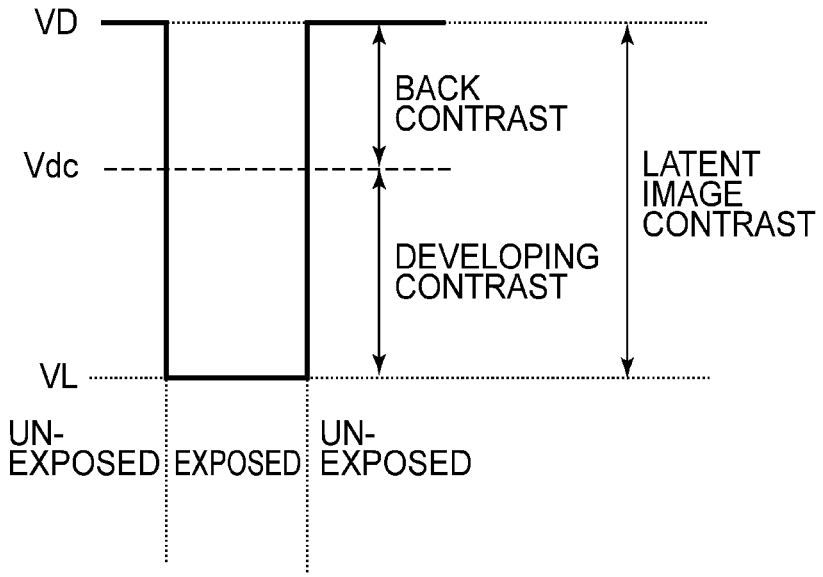
FIG. 5 is a model view showing a relationship among potentials of the photosensitive drum.

Next, in the constitution in this embodiment, a factor for determining the (end of) lifetime of the photosensitive drum 11 will be described. The lifetime of the photosensitive drum 11 is determined by a limit at which a necessary latent image contrast can be ensured. As shown in FIG. 5, the latent image contrast is a difference between the surface potential (dark-portion potential) VD of the photosensitive drum 11 charged by the charging means 12 and the surface potential (exposed-portion potential) VL of the photosensitive drum 11 exposed to light by the exposure means 20. The latent image contrast is divided into two contrasts consisting of a back contrast which is a difference between the dark-portion potential VD and a DC voltage value Vdc of the developing bias, and a developing contrast which is a difference between the DC voltage value Vdc and the exposed portion potential VL.

Figure 6:
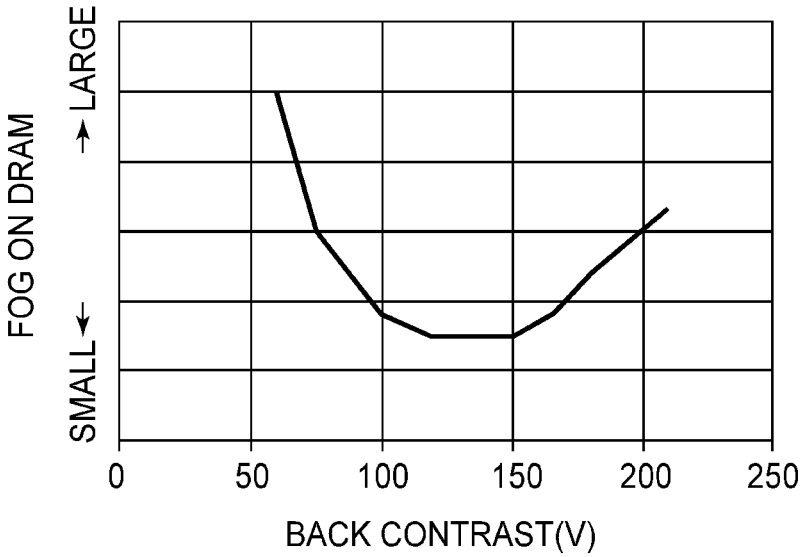
FIG. 6 is a graph showing a relationship between a back contrast and an amount of fog on the photosensitive drum.

It has been known that when the back contrast is smaller than a predetermined value, a fog phenomenon that the toner jumps onto also a white background portion and a phenomenon that a line on the image becomes thick are generated. FIG. 6 shows a relationship between the back contrast and an amount of fog toner on the photosensitive drum 11. In the constitution in this embodiment, there is a tendency that when the back contrast is 100 V or less, the fog toner amount is abruptly increased. On the other hand, there is a tendency that when the back contrast exceeds 170 V, the fog amount of the toner charged to the opposite polarity is increased, and therefore, a target value of the back contrast is set at 150 V.

Figure 7:
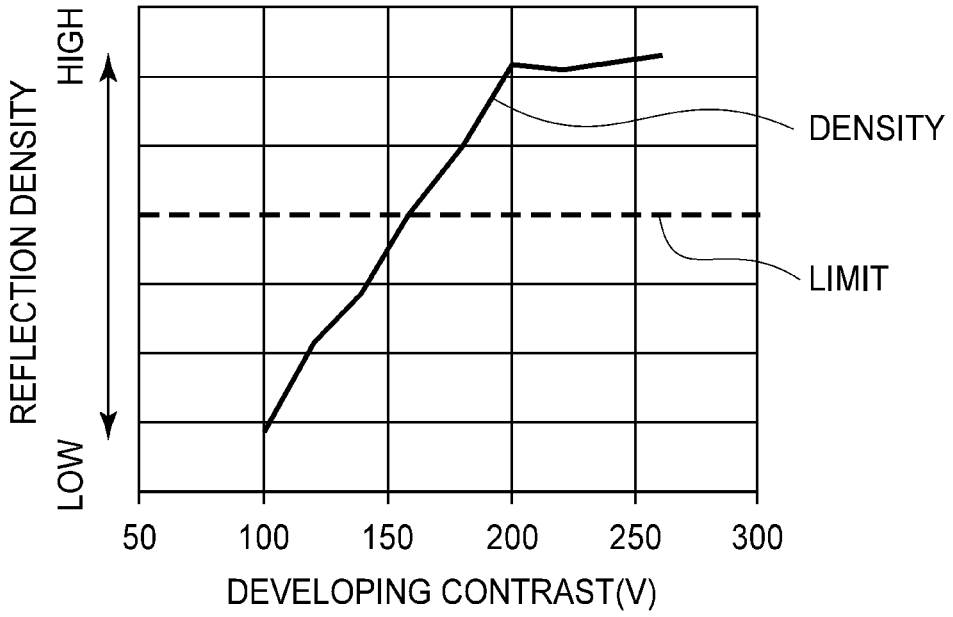
FIG. 7 is a graph showing a relationship between a developing contrast and a density.

When the developing contrast is smaller than a predetermined value, a phenomenon that an amount of the toner jumping onto the photosensitive drum 11 becomes insufficient and thus an image density becomes low. FIG. 7 shows a relationship between the developing contrast and the image density (reflection density) of the recording material (paper). It is understood that when the developing contrast is below 160 V, the image density is below a limit value (at a level where the density is discriminated as being low). For that reason, the (end of) lifetime of the photosensitive drum 11 is determined by a limit value where the back contrast and the developing contrast can be sufficiently ensured. In this embodiment, the value is about 310 V.

<Conventional Discriminating Method of Photosensitive Drum Lifetime>

As a conventional method of discriminating the (end of) lifetime of the photosensitive drum 11, a method in which the surface potential of the photosensitive drum 11 is measured and then the photosensitive drum lifetime is discriminated by whether or not the latent image contrast is ensured has been known. Further, a method in which the rotation number, rotation time or the like of the photosensitive drum 11 is counted as first information, and when the counted value reaches a predetermined threshold, the lifetime of the photosensitive drum 11 is discriminated, and the like method have also been known.

However, in the method in which the surface potential is directly measured, particularly as in the constitution in this embodiment, there is a need to provide a measuring means at each of the image forming stations 10, and thus the image forming apparatus 1 is upsized, and therefore it is difficult to satisfy a demand for recent downsizing.

Further, in the method in which the photosensitive drum is discriminated on the basis of the rotation number or rotation time of the photosensitive drum 1, there is the case where the lifetime cannot be discriminated with high accuracy. That is, the case is such that the photosensitive drums, such as the photosensitive drums 11Y, 11M and 11C of the first to third image forming stations 10Y, 10M and 10C, in the operation in the monochromatic mode are rotated in a state, in which the photosensitive drums are not subjected to image exposure and discharging exposure, different from a state during the image formation.

This is because a degree of light fatigue of the photosensitive drum 11 is not taken into consideration although the thickness of the charge transporting layer of the photosensitive drum 11 can be roughly estimated on the basis of the rotation number. The present inventors found that the photosensitive drum 11 which is not subjected to light exposure is not light-fatigued and therefore is capable of being used even in the case of the same thickness.

<Relationship Between Charge Transporting Layer Thickness and Latent Image Contrast>

Figure 8:
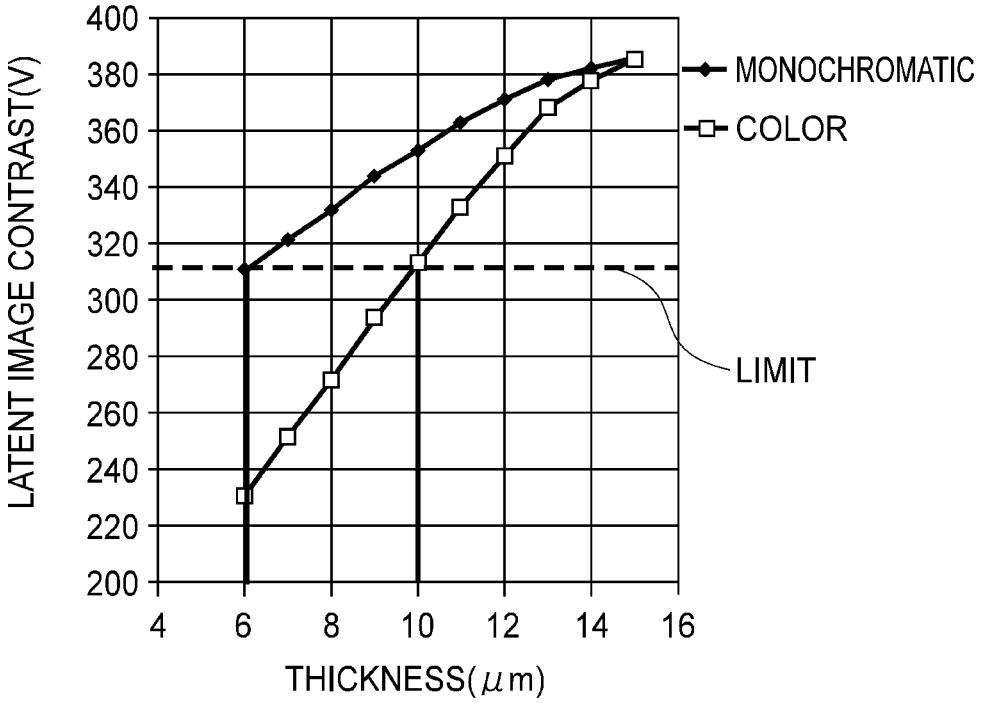
FIG. 8 is a graph showing a relationship between a thickness of a charge transporting layer of the photosensitive drum and a latent image contrast.

FIG. 8 shows a relationship between the thickness of the photosensitive drum 11Y of the first image forming station (yellow station) 10Y and the latent image contrast when the printing by the image forming apparatus 1 is started from a brand-new state of the photosensitive drum 11. An exposure condition is such that a voltage of −1100 V is applied to the charging roller 12 and the photosensitive drum 11 is exposed to light at a laser light quantity of 0.30 ($\mu J/cm^2$) by the exposure means 20. In FIG. 8, "◆" represents the case of only the monochromatic mode, and "□" represents the case of only the color mode. Further, in FIG. 8, the latent image contrast is a value (V) when the printing is effected by providing an interval every (one) sheet.

The latent image contrast has sensitivity to the charge transporting layer thickness of the photosensitive drum 11, so that there is a tendency that the latent image contrast is gradually decreased when the layer thickness is decreased. Further, a degree of the decrease is different between when the printing is effected only in the color mode and when the printing is effected only in the monochromatic mode. In the operation in the color mode, in the discharging step, the whole region of the photosensitive drum 11 is subjected to the exposure to the LED light and therefore a received light quantity is large. On the other hand, the photosensitive drum 11 is not exposed to the LED light in the operation in the monochromatic mode. For that reason, in the operation in the color mode, the sensitivity is lowered by the light fatigue, and thus the latent image contrast cannot be readily ensured.

In the constitution in this embodiment, there is a need to ensure the latent image contrast of 310 V or more. For that reason, a lifetime thickness of the photosensitive drum 11 is 10 μm when the printing is effected only in the color mode and is 6 μm when the printing is effected only in the monochromatic mode. This difference in lifetime thickness is a difference due to the light fatigue, so that lifetime discrimination made in view of not only the lifetime thickness but also the degree of the light fatigue leads to detection of the lifetime of the photosensitive drum 11 with high accuracy.

<Lifetime Control of Photosensitive Drum in this Embodiment>

Next, lifetime control of the photosensitive drum 11 in this embodiment will be described. First, a method of estimating the charge transporting layer thickness of the photosensitive drum 11 will be described.

The charge transporting layer is principally abraded (worn) by friction with the drum cleaner 14. An amount of abrasion (wearing) is different between when the photosensitive drum 11 is subjected to electric discharge in the charging step and when the photosensitive drum 11 is not subjected to the electric discharge in the charging step. When the photosensitive drum 11 is subjected to the electric discharge, the charge transporting layer tends to be abraded in a large amount. In this embodiment, a ratio of the former to the latter is about 2.0. In this embodiment, the photosensitive drum rotation time is divided into a rotation time t1 when the voltage is applied to the charging roller 12 and a rotation time t2 when the voltage is not applied to the charging roller 12, and then is integrated, so that the lifetime thickness is calculated by using the following formula (1).

$$Cnow = Cinitial - A \times (t1 \times 2 + t2) \quad (1)$$

Cnow: charge transporting layer thickness at present

Cinitial: charge transporting layer thickness at an initial stage

A: coefficient of abrasion t1: photosensitive drum rotation time under voltage application to the charging roller t2: photosensitive drum rotation time under no voltage application to the charging roller That is, a photosensitive member lifetime thickness detection function portion (photosensitive drum lifetime thickness detecting means) 102 of the control portion 100 calculates (detects) the charge transporting layer thickness Cnow of the photosensitive member at present by using the above formula (1).

Next, a method of detecting the degree of the light fatigue of the photosensitive drum 11 will be described. In the constitution in this embodiment, a principal factor of the light fatigue of the photosensitive drum 11 is light (optical) discharge by the discharging LED unit 40 in the discharging step. An amount of light exposure received by the photosensitive drum 11 in the discharging step is 1.00 ($\mu J/cm^2$) which is a light quantity considerably larger than the amount of light exposure (0.30 ($\mu J/cm^2$)) received by the photosensitive drum 11 in the exposure step during normal image formation.

Further, in the normal exposure step (image exposure), the entire surface of the photosensitive drum 11 is not exposed to light at all times but a print ratio is about 5%, and therefore the influence of the normal exposure step on the lowering in sensitivity of the photosensitive drum 11 is small. Therefore, the time in which the photosensitive drum 11 is subjected to the discharging step largely affects the sensitivity of the photosensitive drum 11.

For that reason, in this embodiment, the (light) emission time of the discharging LED unit 40 is measured and integrated by a counter (counting function portion) 103 of the control portion 100, so that the degree of the light fatigue is estimated. That is, a photosensitive member received light quantity detecting function portion (photosensitive member received light quantity detecting means) 104 of the control portion 100 measures and counts the emission time of the discharging LED unit 40 by the counter 103, thus detecting the received light quantity of the photosensitive member (light fatigue) on the basis of the emission time of the discharging LED unit 40.

The latent image contrast for determining the lifetime is, as described above, correlated with the lifetime thickness and received light quantity of the charge transporting layer. Therefore, the present inventors obtained the received light quantity (discharging LED emission time) capable of ensuring a necessary latent image contrast for each lifetime thickness by study, and then determined a threshold.

Figures 9, 10:
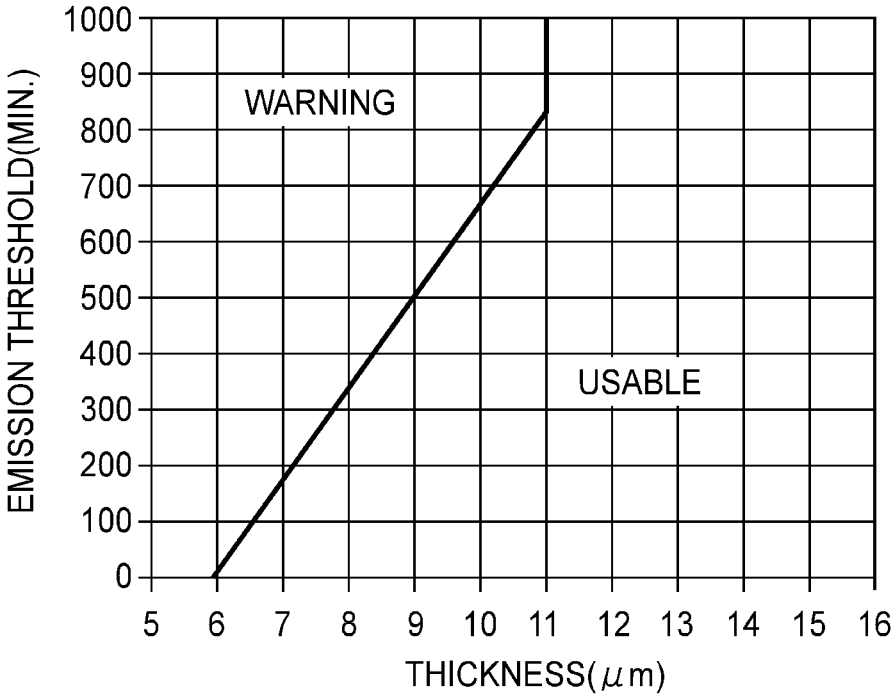
FIG. 9 is a graph showing a relationship between the thickness of the charge transporting layer of the photosensitive drum and a threshold of an LED (light) emission time.
FIG. 10 is a table showing a relationship between the thickness of the charge transporting layer and a fatigue coefficient.

FIG. 9 shows a relationship between the charge transporting layer thickness and the threshold of the LED emission time. In the constitution in this embodiment, until the thickness of 11 μm, the latent image contrast can be ensured irrespective of the LED emission time, and therefore the lifetime discrimination is made on the basis of a relationship between the thickness of 11 μm or less and the LED emission time. For example, in the case where the thickness is 11 μm, when the integrated value of the LED emission time reaches about 840 minutes, lifetime (end) notification is made. In the case where the thickness is 9 μm, when the integrated value of the LED emission time reaches 500 minutes, lifetime notification is made. In a state in which the photosensitive drum 11 is not exposed to light at all, the photosensitive drum 11 is usable until the charge transporting layer thickness is decreased to 6 μm.

<Flow Chart of Lifetime Discrimination of Photosensitive Drum 11>

Figure 1:
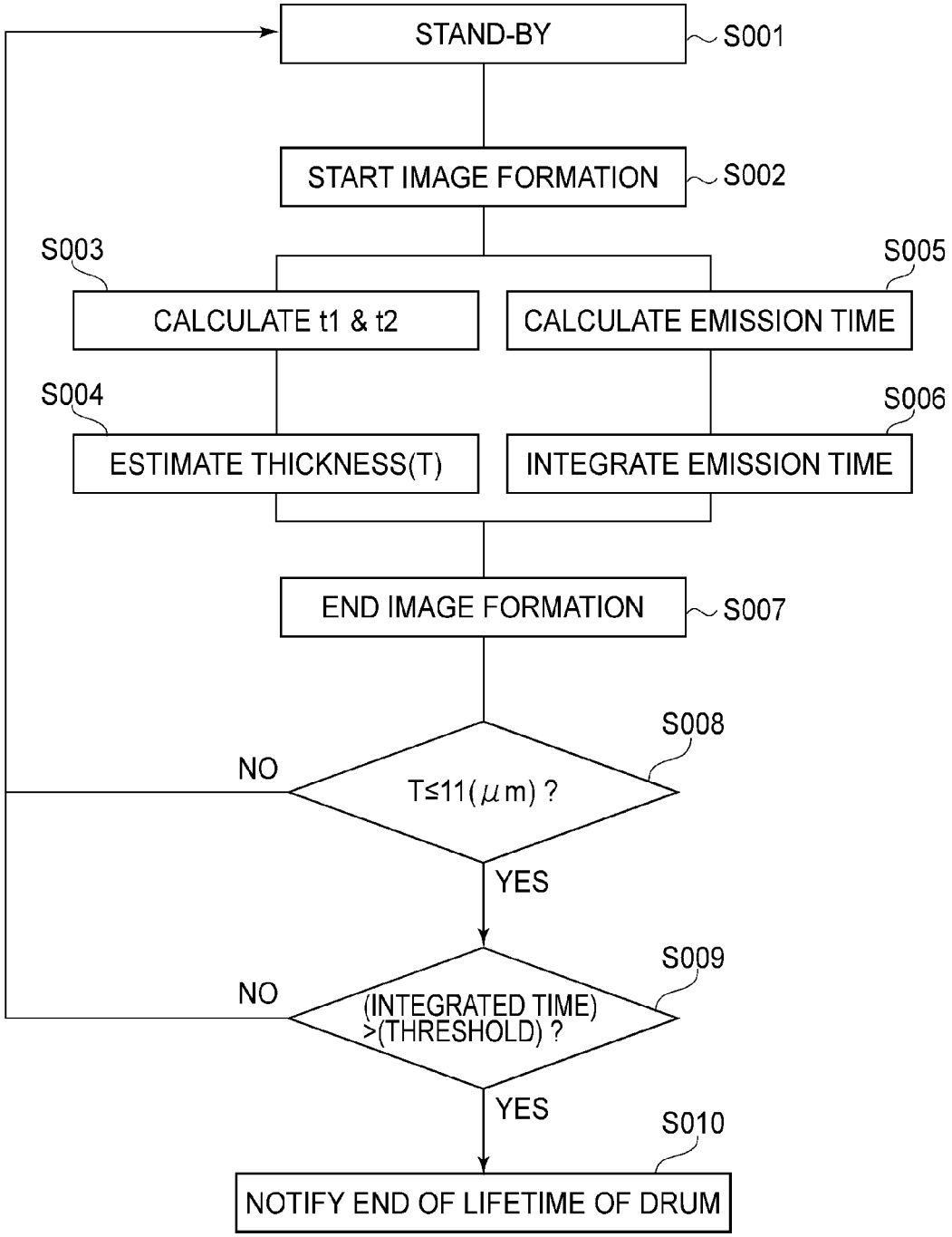
FIG. 1 is a flow chart for discriminating an end of a lifetime of a photosensitive drum of an image forming apparatus in Embodiment 1.

FIG. 1 show a flow of lifetime discrimination (detection) of the photosensitive drum 11 in this embodiment. This lifetime detection is performed by the control portion 100 also functioning as a detecting portion. The control portion 100 measures, when the image forming apparatus 1 starts an image forming operation from a stand-by state (S001, S002), rotation times (first information) of the photosensitive drum 11 by the photosensitive member thickness detecting function portion 102 (S003), and then estimates the charge transporting layer thickness from a measurement result (S004). Concurrently, the control portion 100 measures the emission time of the discharging LED unit 40 by the photosensitive member received light quantity detecting function portion 104 (S005), and then calculates an integrated emission time (second information) by adding the measured emission time to the last integrated emission time (S006).

After the image formation is ended (S007), at first, the control portion 100 discriminates whether or not the lifetime thickness is 11 μm or less (S008). When the control portion 100 discriminates that the thickness is larger than 11 μm, the sequence is returned to the stand-by state. When the thickness is 11 μm or less, there is a possibility that the photosensitive drum 11 reaches an end of its lifetime, and therefore the control portion 100 makes the lifetime discrimination. From the relationship between the thickness and the emission time threshold shown in FIG. 9, the emission time threshold corresponding to the charge transporting layer thickness at that time is set, and then the integrated emission time and the set integrated emission time threshold are compared (S009). When the integrated emission time is not larger than the threshold (NO of S009), the sequence is returned to the stand-by state. When the integrated emission time is larger than the threshold (YES of S009), the control portion 100 discriminates that the photosensitive drum 11 reaches the end of its lifetime, and then provides warning notification (S010).

That is, the control portion 100 detects the (end of) lifetime of the photosensitive drum (photosensitive member) 11 on the basis of a detection result of the member lifetime thickness detecting function portion (photosensitive member lifetime thickness detecting means) 103 and a detection result of the photosensitive member received light quantity detecting function portion (photosensitive member received light quantity detecting means) 104.

The warning notification when the control portion 100 discriminates that the photosensitive drum 11 reaches its lifetime is, in this embodiment, made by displaying a massage to the effect that the photosensitive drum 11 reaches its lifetime, on a display portion 106 of an operating portion 105 or on a display portion 202 of the controller 200. A user performs, on the basis of the warning notification, necessary procedures such as exchange (replacement) of the cartridge 80.

In the constitution in this embodiment, in the case where the lifetime discrimination is made on the basis of only the thickness as in the conventional method, e.g., when the lifetime is discriminated on the basis of the thickness of 10 μm, a printable sheet number in one-sheet interval printing was 5,000 sheets in the color mode and 10,000 sheets in the monochromatic mode. On the other hand, by using the method, as the method of the present invention, in which the lifetime is discriminated on the basis of the received light quantity and lifetime thickness of the photosensitive drum 11, the printable sheet number was 5,000 sheets in the color mode similarly as in the conventional method, but was increased up to 18,000 sheets in the monochromatic mode. Further, until the lifetime (end) notification was provided, there was no problem with respect to an image quality.

Thus, by effecting the lifetime discrimination of the photosensitive drum 11 on the basis of the lifetime thickness and the received light quantity, it became possible to use the photosensitive drum 11 efficiently while maintaining a good image quality. The information on the lifetime thickness and the information on the received light quantity which are important information in the present invention are stored in the memory medium 82 provided on each cartridge 80. As a result, even when the cartridge 80 during use is mounted in another image forming apparatus, it becomes possible to make the lifetime discrimination with reliability.

[Embodiment 2]

In this embodiment, an image forming apparatus used is the same as the image forming apparatus 1 in Embodiment 1 except that the discharging means 40 is not used. In this embodiment, in order to discharge (remove) the potential of the surface of the photosensitive drum 11 after the image formation, by using the image exposure means 20 after the end of the image forming operation, the laser irradiation (whole surface laser irradiation) is performed along a longitudinal direction of the photosensitive drum 11 correspondingly to several full-circumferences of the photosensitive drum 11.

In the post-rotation step performed after the image formation, the photosensitive drum 11 is subjected to the whole surface laser irradiation. For that reason, the number of operations of the post-rotation is different between continuous printing (in which the post-rotation is performed every 100 sheets) and printing for each (one) sheet (in which the post-rotation is performed every sheet), and therefore when the lifetime thickness is simply estimated, it is difficult to accurately discriminates the lifetime of the photosensitive drum 11. In the printing for each sheet in which the photosensitive drum 11 is subjected to the laser irradiation in the post-rotation step, even when the lifetime thickness is the same, there is a tendency that the latent image contrast is not readily ensured.

Therefore, similarly as in Embodiment 1, the lifetime discrimination made on the basis of the lifetime thickness at that time and the integrated received light quantity calculated from the laser irradiation (emission) time and the corresponding light quantity based on the threshold of the received light quantity set for each lifetime thickness is effective. That is, in this embodiment, the received light quantity detected by the photosensitive member received light quantity detecting function portion (photosensitive member received light quantity detecting means) 104 of the control portion 100 is an integrated value of the number of dots or exposure time of the photosensitive drum 11 subjected to exposure to light by the exposure means 20.

In the conventional method, in both of the cases of the printing for each sheet and the continuous printing, the photosensitive drum lifetime was discriminated on the basis of the same lifetime thickness. On the other hand, by discriminating the photosensitive drum lifetime in accordance with the method in this embodiment, it became possible to properly discriminate the lifetime of the photosensitive drum 11 to efficiently use the photosensitive drum 11 while maintaining the image quality even in various use methods.

[Embodiment 3]

An image forming apparatus used in this embodiment is substantially the same as the image forming apparatus used in Embodiment 2. A difference from Embodiment 2 is that background exposure control for exposing a white background portion, where the toner image is not formed, at a small light quantity is effected. In the background exposure, although the high quantity is small, the photosensitive drum 11 is always exposed to the laser light. For that reason, the light fatigue is generated in the photosensitive drum 11 in some cases.

In such a constitution, by measuring the received light quantity in the background exposure, the resultant value can be used as a parameter of a degree of the light fatigue of the photosensitive drum 11. When a threshold of the received light quantity for each lifetime thickness is set on the basis of a relationship among the received light quantity, the lifetime thickness and the latent image contrast in the background exposure, it becomes possible to obtain the effect of the present invention such that the lifetime of the photosensitive drum 11 can be discriminated with high accuracy.

That is, also in this embodiment, the received light quantity (second information) detected by the photosensitive member received light quantity detecting function portion (photosensitive member received light quantity detecting means) 104 of the control portion 100 is the integrated value of the number of dots or emission time of the photosensitive drum 11 subjected to exposure to the laser light by the exposure means 20.

[Embodiment 4]

In this embodiment, an image forming apparatus use has the same constitution as the image forming apparatus 1 described in Embodiment 1, but an integrating method of the emission time of the discharging LED unit 40 is different from that in Embodiment 1. The difference is as follows.

With respect to the degree of light fatigue, there was a tendency that the light fatigue degree was largely influenced by the quantity of light received when the charge transporting layer thickness of the photosensitive drum 11 was small. For that reason, in order to make the photosensitive drum lifetime discrimination with further high accuracy, in this embodiment, a value obtained by multiplying the discharging LED emission time by a fatigue coefficient y every lifetime thickness.

The photosensitive drum lifetime discriminating method in this embodiment will be described. FIG. 10 shows a relationship between the lifetime thickness and the fatigue coefficient y in this embodiment. For each of the lifetime thicknesses, the fatigue coefficient is provided so that the fatigue coefficient has a large value with a decreasing lifetime thickness. The control portion 100 integrates the LED emission time every printing operation to calculate a light fatigue value obtained by multiplying the integrated LED emission time by the fatigue coefficient y corresponding to the lifetime thickness at that time, and then adds the light fatigue value to a cumulative light fatigue value integrated until that time. A threshold of the cumulative light fatigue value as a boundary value used for discriminating the lifetime in advance is provided every lifetime thickness, and then the lifetime thickness at that time is calculated every printing operation and concurrently the cumulative light fatigue value is compared with the threshold depending on the lifetime thickness, so that the lifetime discrimination is made.

Even in the case where a total received light quantity (total LED emission time) is the same, when the charge transporting layer is exposed to light in a large amount at the time when the charge transporting layer is thick, the light fatigue value becomes smaller than when the charge transporting layer is exposed to light in the large amount at the time when the charge transporting layer becomes thin. As a result, it becomes possible to effect control which meets a phenomenon such that the influence of the quantity of light received when the charge transporting layer thickness of the photosensitive drum 11 is thin is large. Therefore, by using this method, compared with Embodiment 1, it became possible to discriminate the photosensitive drum lifetime with further high accuracy.

Further, in this embodiment, in order to measure the light fatigue degree with high accuracy, the light fatigue degree is calculated by providing the fatigue coefficient for each lifetime thickness. However, e.g., in the case where the last received light quantity largely affects the sensitivity, a method of calculating the light fatigue degree by measuring the received light quantity in a period in which the charge transporting layer of the photosensitive drum 1 is abraded in a thickness of 1 μm is also effective.

[Other Embodiments]

1) In the above embodiments, the difference between the color mode and the monochromatic mode is described, but in addition thereto, also in the case where there is timing such that the photosensitive drum 11 is rotated without being subjected to the discharging step, the above-described lifetime discriminating methods of the photosensitive drum 11 are similarly effective.

For example, in the case where an image of red alone is formed, in order to form superposed toner images of Y and M, the first and second image forming stations 10Y and 10M perform the image forming operation. At the third and fourth image forming stations 10C and 10K, the photosensitive drums 11 are rotated but do not perform the image forming operation and also are not subjected to the discharging step.

Further, in the case where an image of blue alone is formed, in order to form superposed toner images of M and C, the second and third image forming stations 10M and 10C perform the image forming operation. At the first and fourth image forming stations 10Y and 10K, the photosensitive drums 11 are rotated but do not perform the image forming operation and also are not subjected to the discharging step.

Further, in the case where an image of green alone is formed, in order to form superposed toner images of Y and C, the first and third image forming stations 10Y and 10C perform the image forming operation. At the second and fourth image forming stations 10M and 10K, the photosensitive drums 11 are rotated but do not perform the image forming operation and also are not subjected to the discharging step.

In addition to the above, in combinations of various colors, various combinations of the image forming station, where the image forming operation is performed, with the image forming station where the photosensitive drum 11 is rotated but do not perform the image forming operation and also is not subjected to the discharging step can be used.

2) The image forming apparatus according to the present invention may also have a constitution in which the recording material is carried by a conveying device without using the intermediary transfer member and then is passed through the transfer position of the image forming station to form the toner image thereon.

3) In the image forming apparatus 1 in the embodiments described above, the first to fourth (four) image forming stations for the four colors are provided. However, the number of colors is not limited to 4, and the order of arrangement of the four image forming stations is not limited to that described above. That is, it is also possible to employ an image forming apparatus constitution in which the number of the image forming stations is 2, 3 or 5 or more.

4) The color image forming apparatus is described in the above embodiments, but the image forming apparatus is not limited thereto. Also in a monochromatic image forming apparatus, the above-described photosensitive drum lifetime discriminating method is also effective in the case where the quantity of light received by the photosensitive drum 11 varies depending on a use method and thus the photosensitive drum lifetime cannot be discriminated on the basis of only the lifetime thickness.

5) In the present invention, the image forming apparatus may also include image forming apparatuses (display apparatus, electronic blackboard apparatus, electronic white board apparatus, etc.) in which the toner image formed on the photosensitive member or the toner image transferred from the photosensitive member onto the intermediary transfer member is displayed at the display portion.

According to the present invention, by detecting the photosensitive member lifetime on the basis of the thickness information of the charge transporting layer of the photosensitive member and the information on the received light quantity of the photosensitive member, it became possible to discriminate the photosensitive member lifetime with a higher degree of accuracy than that in the conventional method.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 113520/2012 filed May 17, 2012, which is hereby incorporated by reference.

What is claimed is:

1. An image forming apparatus comprising:

a rotatable photosensitive member;

an exposure unit for exposing a surface of said photosensitive member to light; and a detecting portion for detecting a lifetime of said photosensitive member on the basis of both i) first information on a thickness of a charge transporting layer of said photosensitive member and ii) second information on an amount of the light received by the charge transporting layer of said photosensitive member, wherein when the first information reaches a first threshold, the detecting portion determines whether or not the second information reaches a second threshold.

2. An image forming apparatus according to claim 1, wherein the first information is an integrated value of the number of rotations of said photosensitive member.

3. An image forming apparatus according to claim 1, wherein the first information is an integrated value of a rotation time of said photosensitive member.

4. An image forming apparatus according to claim 1, wherein the second information is an integrated value of the number of dots on said photosensitive member exposed to light by said exposure unit.

5. An image forming apparatus according to claim 1, wherein the second information is an integrated value of an exposure time of said photosensitive member by said exposure unit.

6. An image forming apparatus according to claim 1, further comprising:

a charging member for electrically charging the surface of said photosensitive member to a predetermined potential; and a transfer member for transferring a toner image, formed on the surface of said photosensitive member, onto an intermediary transfer member or a recording material, wherein said exposure unit exposes the surface of said photosensitive member to light after transfer by said transfer member and before charging by said charging member.

7. An image forming apparatus according to claim 1, wherein said exposure unit exposes the surface of said photosensitive member to light after transfer by a transfer member and before charging by a charging member.

8. An image forming apparatus comprising:

a rotatable photosensitive member;

an exposure unit for exposing a surface of said photosensitive member to light; and a detecting portion for detecting a lifetime of said photosensitive member on the basis of both (i) first information on an integrated value of the number of rotations of said photosensitive member or an integrated value of a rotation time of said photosensitive member, and (ii) second information on an integrated value of the number of dots on said photosensitive member exposed to light by said exposure unit or an integrated value of an exposure time of said photosensitive member by said exposure unit, wherein when the first information reaches a first threshold, the detecting portion determines whether or not the second information reaches a second threshold.

9. An image forming apparatus according to claim 8, further comprising:

a charging member for electrically charging the surface of said photosensitive member to a predetermined potential; and a transfer member for transferring a toner image, formed on the surface of said photosensitive member, onto an intermediary transfer member or a recording material, wherein said exposure unit exposes the surface of said photosensitive member to light after transfer by said transfer member and before charging by said charging member.

* * * * *